United States Patent [19]

Pechner

[11] 4,337,737

[45] Jul. 6, 1982

[54] TEMPERATURE REGULATOR FOR OIL COOLING SYSTEM

[76] Inventor: Murray Pechner, 2309 W. 144th St., Gardena, Calif. 90249

[21] Appl. No.: 148,566

[22] Filed: May 9, 1980

[51] Int. Cl.[3] ..... F01M 1/00

[52] U.S. Cl. ..... 123/196 AB; 165/40

[58] Field of Search ..... 123/196 AB; 165/40; 236/93 R, 34

[56] References Cited

U.S. PATENT DOCUMENTS 3,411,712 11/1968 O'Hara et al. ..... 165/40

3,990,504 11/1976 Kolthoff, Jr. ..... 165/40

FOREIGN PATENT DOCUMENTS 841448 7/1960 United Kingdom ..... 236/93 R

*Primary Examiner*—Charles J. Myhre

*Assistant Examiner*—E. Rollins Cross

*Attorney, Agent, or Firm*—Lewis B. Sternfels

[57] ABSTRACT

An oil cooler (10) for an internal combustion engine includes a regulator (26) with a bimetallic element (28) which is adapted to close off all but one end (22) of parallel flow paths extending between an inlet plenum (12) and an outlet plenum (14) of the cooler. Increasing the oil temperatures causes the element to bend away from the openings and thus to open more of the conduits to passage and cooling of the oil through the cooler.

5 Claims, 5 Drawing Figures

Fig. 1.
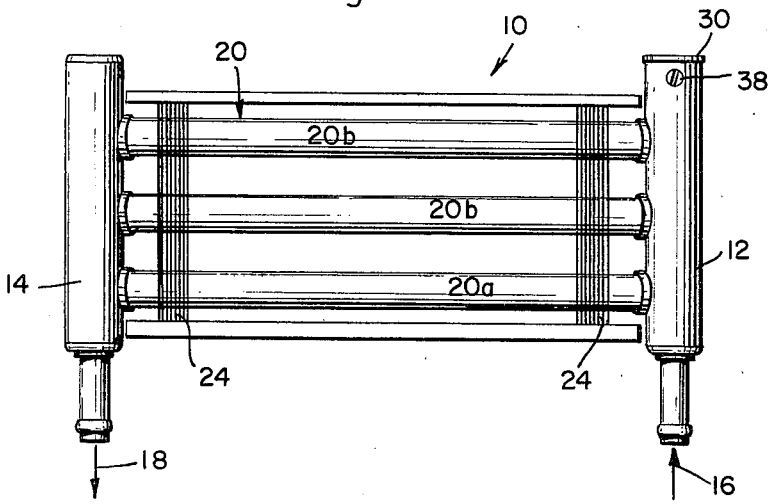
Fig. 2.
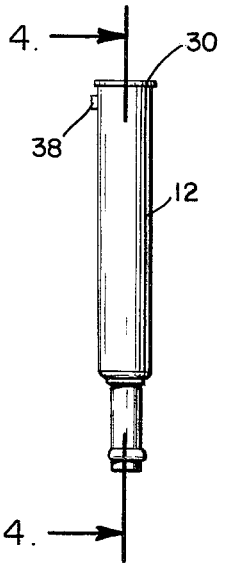
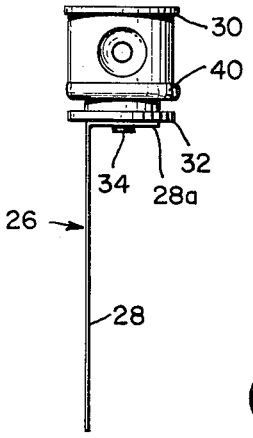
Fig. 3.
Fig. 4.
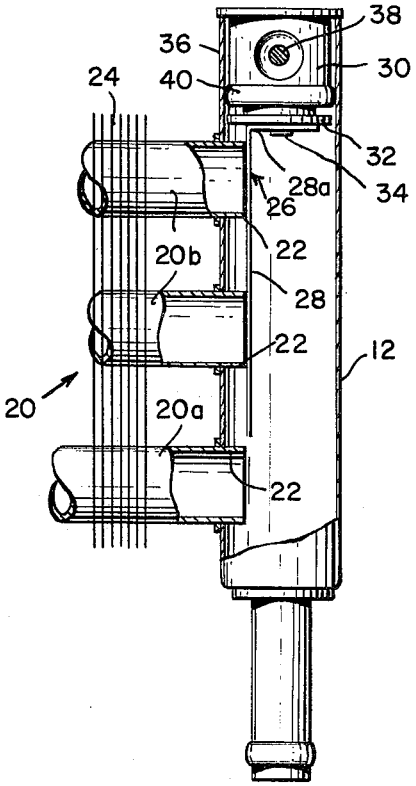
Fig. 5.
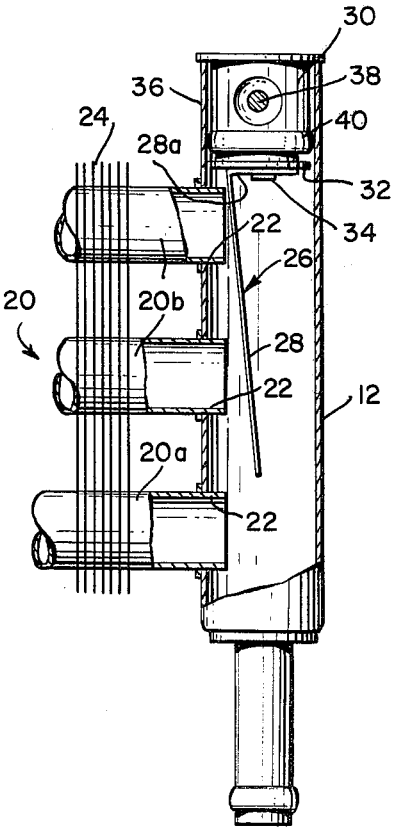

TEMPERATURE REGULATOR FOR OIL COOLING SYSTEM

BACKGROUND OF THE INVENTION

1. Field of the Invention

The present invention relates to an oil cooling system for an internal combustion engine and, in particular, to the improvement whereby temperature and viscosity of the oil is regulated particularly during the initial warmup time of the engine.

2. Description of the Prior Art

Until an internal combustion engine is fully warmed up, the oil flowing therethrough is not at its optimal viscosity and temperature, e.g., to insure that any water in the system will not condense. In addition, it is important that the temperature of the oil not be permitted to rise beyond permissible limits; therefore oil coolers are used, either as part of the radiator system or as a separate oil cooler. While the maximum cooling effected by the air coolers are sufficient to cool the oil adequately at normal operating temperatures of the engine, they also prevent the most rapid rise in temperature of the oil during initial warmup of the engine. Therefore, the likelihood of water condensing and causing corrosion exists.

In addition, it is also preferable to reduce the viscosity of the oil as quickly as possible in order to decrease the load on the battery and the starter. Other desirable results of increased viscosity include an increase of gas mileage, and as an aid in preventing decrease in horsepower by reducing the load on the engine.

SUMMARY OF THE INVENTION

The present invention avoids or overcomes these and other problems by providing for a mechanism by which the amount of oil flowing through the oil cooler is regulated directly in proportion to the temperature of the oil. Specifically, in its preferred embodiment, a temperature responsive valve is placed at the entry of parallel flow paths in the oil cooler. When the temperature of the oil is low, at a selected temperature, the valve closes all but one of the parallel paths. As the temperature of the oil increases, the raised temperature causes the valve correspondingly and proportionately to open the otherwise closed tubes to permit more oil to be passed through the cooler.

It is, therefore, an object of the present invention to provide for temperature regulation of oil in an oil cooler.

Another object is to provide for rapid decrease in the viscosity of oil, especially during initial warmup times of an internal combustion engine.

Other aims and objects, as well as a more complete understanding of the present invention, will appear from the following explanation of an exemplary embodiment and the accompanying drawings thereof.

BRIEF DESCRIPTION OF THE DRAWINGS

FIG. 1 is a plan view of an oil cooler embodying the present invention;

FIG. 2 is an end view of the oil cooler depicted in FIG. 1;

FIG. 3 is an elevational view of the regulator used in controlling the amount of flow of oil through the cooler;

FIG. 4 is a partial view of the oil inlet end of the cooler with the temperature regulator in place prior to warmup of the engine; and FIG. 5 is a view similar to that shown in FIG. 4 but with the regulator being open after initial warmup of the engine.

DESCRIPTION OF THE PREFERRED EMBODIMENTS

Referring to FIG. 1, an oil cooler 10 comprises an inlet plenum 12 and outlet plenum 14 for delivery of oil into and through the cooler as denoted by arrows 16 and 18. Extending between the two plenums are a plurality of paths or conduits 20 which open at their ends into the plenums. Specifically, as shown in FIGS. 4 and 5, conduits 20 open at their ends 22 into plenum 12. To provide for efficient cooling of the oil, a plurality of fins 24 extend between the plenums in contact with conduits 20 so that circulating air will more efficiently remove heat from the oil cooler.

In order to regulate the amount of oil passing through cooler 10 and subject to cooling by fins 24, a regulator or valve 26 is introduced into inlet plenum 12 in order to block off, preferably, all but one of conduits 20, although even the last open path may be partially closed off or restricted if oil flow is to be so limited. Thus, there will be insured at least one conduit 20*a* or part thereof through which oil will always flow. Regulator 26 preferably comprises a bimetallic element 28 of conventional construction which can bend to a greater or lesser extent depending upon the amount of heat contacting the element. Bimetallic element 28 is secured to a plug 30 at its bottom base 32 by any suitable means, such as a rivet 34. Plug 30 is disposed to be inserted within the top or upper end 36 of plenum 12 and is retained therein by any suitable means, such as by a set screw 38, welding, gluing, soldering and brazing. An O-ring 40 provides a fluid tight seal between the plug and the plenum.

In operation, when the internal combustion engine is cold, the oil therein is likewise cold and relatively viscous, and bimetallic element 28 of regulator 26 completely closes off ends 22 of conduits 20*b*. Accordingly, oil is permitted to flow only through conduit 20*a* or a portion thereof, if bimetallic strip 28 is extended to cover a portion of conduit 20*a* at its end. As the engine temperature rises, the temperature of the oil correspondingly rises which causes element 28 to deflect away from the ends of formerly closed conduits 20*b*. Proportionate rise in oil temperature causes proportionate increasing opening of the two formerly closed conduits.

While a removable plug 30 is depicted, it is equally suitable, if desired, that element 28 at its end 28*a* be connected directly to the plenum wall by any suitable means, rather than to a specially made plug. In addition, element 28 may be slightly dimpled inwardly at conduit ends 22 to form a better interconnection therewith. In addition, depending upon the materials and the thickness of element 28, its characteristics for opening and closing ends 22 may be adjusted.

Although the invention has been described with reference to a particular embodiment thereof, it should be realized that various changes and modifications may be made therein without departing from the spirit and scope of the invention.

What is claimed is:

1. In an oil cooler for an internal combustion engine having means defining at least one cooling path for flow of oil extending between oil inlet and outlet plenums, the improvement in regulating the temperature and viscosity of the oil comprising means responsive to the oil temperature and thereby operative to progressively restrict the cooling path means at least partially as the oil temperature decreases and to progressively open the cooling path means as the oil temperature increases.

2. The improvement according to claim 1 in which said restricting and opening means comprises a member in said inlet plenum adjacent an end of the cooling path means and movable against and away from said end.

3. The improvement according to claim 2 in which said member comprises a bimetallic strip hinged to said inlet plenum and bendable into contact with said end at a selected low temperature of the oil and movable away from said end in proportion to the increasing temperature of the oil.

4. The improvement according to claim 3 in which said inlet plenum includes a top wall structure located generally perpendicular to said end and comprising an opening, and a plug inserted in said opening with a fluid-tight seal therewith, said plug having a bottom face and said bimetallic strip having a bent-over portion affixed to said bottom face.

5. The improvement according to claims 3 or 4 in which said path means comprises at least two paths, and in which at least one of said paths is continuously open to the oil flow and the remainder of said paths are closeable by said bimetallic strip.

* * * * *